United States Patent [19]

Kitai

[11] Patent Number: 4,781,667

[45] Date of Patent: Nov. 1, 1988

[54] SECOND-FOLD ROLLERS FOR A FOLDING DEVICE

[75] Inventor: Mitsuo Kitai, Kanagawa, Japan

[73] Assignee: Kabushikigaisha Tokyo Kikai Seisakusho, Tokyo, Japan

[21] Appl. No.: 26,876

[22] Filed: Mar. 17, 1987

[30] Foreign Application Priority Data

Mar. 28, 1986 [JP] Japan ..... 61-45871[U]

[51] Int. Cl.[4] ..... B65H 45/16

[52] U.S. Cl. ..... 493/359; 493/434; 493/445; 493/471; 493/473

[58] Field of Search ..... 493/434, 435, 444, 445, 493/468, 471, 473, 476

[56] References Cited

U.S. PATENT DOCUMENTS 594,245 11/1897 Gill ..... 493/445
2,536,165 1/1951 Foster ..... 493/427
3,576,051 4/1971 Click ..... 493/435
4,493,690 1/1985 Niemiro et al. ..... 493/444

*Primary Examiner*—Frederick R. Schmidt
*Assistant Examiner*—William E. Terrell
*Attorney, Agent, or Firm*—Foley & Lardner, Schwartz, Jeffery, Schwaab, Mack, Blumenthal & Evans

[57] ABSTRACT

The present invention relates to second-fold rollers for a folding device adapted for cutting and folding superposed paper webs into a folded section of superposed sheets. The second-fold rollers are arranged in a pair in parallel each other, at least one of which is provided with at least one of non-contact section so formed as to prevent from contacting with the rear corners of the paper sheet to be passed between these second-fold rollers. The non-contact section is a recess partially formed in its cylindrical surface near each end of the second-fold roller.

5 Claims, 2 Drawing Sheets

SECOND-FOLD ROLLERS FOR A FOLDING DEVICE

BACKGROUND OF THE INVENTION (1) Field of the Invention

The present invention generally relates to a folding device. More particularly, the present invention relates to second-fold rollers for a folding device adapted for cutting and folding superposed paper webs into a folded section of superposed sheets.

(2) Description of the Prior Art

A conventional folding device for a web rotary press performs its folding operation in the following manner:

A paper web is subjected to a vertical folding motion between a former and a nipping roller unit arranged below the former. This vertically folded paper web is wrapped around a folding cylinder by holding the forward end of the web by means of pins fixed on the folding cylinder. The folded web is cut into a sheet of predetermined length by a cutting knife fixed in a cutting cylinder which is arranged in parallel to the folding cylinder. Further, the substantially center of the cut sheet is forcibly inserted into the narrow space between a pair of second-fold rollers by a folding knife fixed on the folding cylinder. This narrow space is so controlled as to be equivalent to the thickness of the cut sheet to be folded.

Finally the cut sheet is laterally folded by restraining between the second-fold rollers.

Such a conventional folding manner is broadly well known by several printed matters such as "Shinbun Insatu Insatu-Hen Kaitei-Ban (Newspaper Press, Printing Edition Revised Version)" edited by Nippon Shinbun Kyokai Kohmu-Linkai (Japan Newspaper Institute, Engineering Commission), Oct., 31, 1975 pages 47 to 48.

According to this publication, the conventional web folding device has employed a specially designed second-fold roller to conduct the nipping operation. In detail, such a fold roller has been provided with stripes or diamondwise pattern formed in its cylindrical surface. Further, another prior art (Japanese utility model Publication No. Sho.59-29008) shows a second-fold roller formed with groove(s) in addition to the stripes or diamondsise pattern and a pair of drag rollers formed with circumferential grooves of predetermined depth and width. These circumferential grooves for the drag rollers are formed in its respective ends so as to contact with each corner of the cut sheet for another purpose.

However, in such conventional folding devices, the rear end of the paper web is cut by the cutting knife and the front end of it is released from the pin of the folding cylinder when the second-fold rollers hold the paper section to be laterally folded. On this occasion, the four corners of the paper sheet are isolated from the cylindrical surface of the folding cylinder. Even if a paper guide is set along the folding cylinder, the cut sheet can be freely moved between the paper guide and the folding cylinder. The cut sheet is accidentally and irregularly folded and the irregularly folded sheet is applied with nipping force by the second-fold rollers. This will often generate undesirable folded sections such as dog ears.

Further, the paper web is always applied with nipping force from the moment when the section to be laterally folded is nipped to the moment when the paper web is wholly fed out of the folding device. For example, folding works for a lot of pages, such as a newspaper, may often have trouble such as waving when the narrow space between the second-fold rollers is not correctly arranged and/or vertically folded sections of the webs become thicker than the other end. This waving phenomenon causes folded wrinkles when this waving becomes so hard that paper webs can not be smoothly moved.

In order to overcome these problems, the inventor of the present application has provided a specially designed second-fold roller pair to improve its lateral folding and web/sheet feeding functions in the previously applied invention; Japanese Utility Model, Application No. Sho.60-47057, Japanese UM Provisional Publication No. 61-176150. Although this specially designed second-fold roller is remarkably effective to a thick paper folding work, it can not adapt to a thin paper folding work. In detail, both edges of such thin paper tend to flutter and this flutter causes dog-ears at the corners of the paper sheet. Further, this specially designed second-fold roller pair can not completely nip the vertically folded section fed from the former.

SUMMARY OF THE INVENTION

It is an object of the present invention to provide improved second-fold rollers for a folding device which prevents the paper sheet passed through the second-fold rollers from generating dog-ears.

Another object of the present invention is to provide second-fold rollers for a folding device which is improved in its working efficiency by eliminating a loss of papers.

To achieve the above described objects, second-fold rollers for a folding device according to one aspect of the present invention comprises a pair of second-fold rollers arranged in parallel with each other, at least one of which is provided with at least one non-contact section, so formed as to prevent contact with the rear corner ends of the paper sheet passed between these second-fold rollers.

According to another aspect of the present invention, the non-contact section contains a recess partially formed in its cylindrical surface near each end of the second-fold rollers.

According to the further aspect of present invention, the non-contact section contains a longitudinal groove formed in its cylindrical surface of the fold rollers.

The above and other objects and features of the invention will appear more fully hereinafter from a consideration of the following description taken in connection with the accompanying drawings wherein one example is illustrated by way of example.

DETAILED DESCRIPTION OF THE PREFERRED EMBODIMENT

Figure 1:
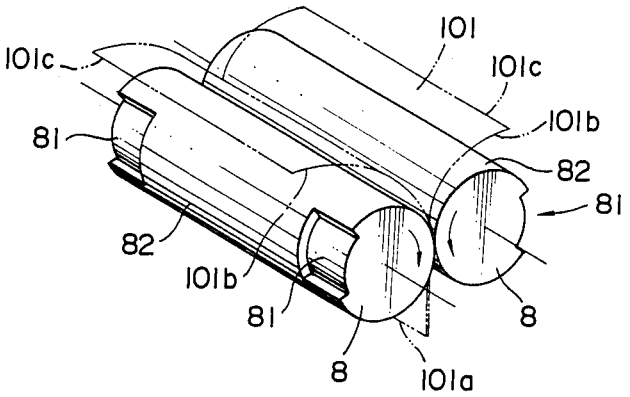
FIG. 1 is a schematic illustration showing the first embodiment of the second-fold rollers according to the present invention.
Figure 2:
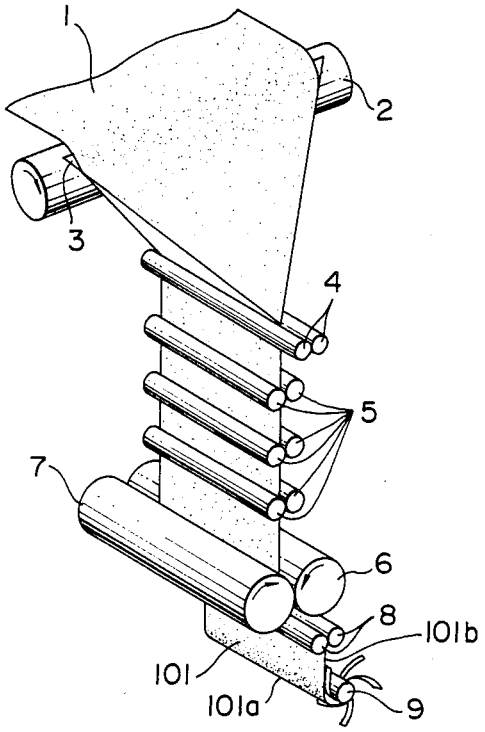
FIG. 2 is a schematic illustration showing a running state of the folding device which contains the second-fold rollers according to the present invention.

Referring to FIG. 1, there is shown a first embodiment of the second-fold rollers according to the present invention. In FIG. 2, there is shown a running state of the folding device in which the first embodied second-fold rollers are assembled.

In the folding device shown in FIG. 2, a paper web 1 is led to a former 3 by means of a drag roller 2. The paper web 1 is subjected to a former folding (vertical folding) work through a pair of forming rollers 4 and a series of nipping rollers 5. The folded sheet is wrapped around a folding cylinder 6 by holding the forward end of the paper web 1 by a pin (not shown) fixed on the cylinder 6.

The cylinder 6 is further provided with a folding blade (not shown) which can mark a lateral folding section on the paper web 1 and make the section insert into second-fold rollers 8. In synchronism with this inserting motion, a cutting knife (not shown) fixed on a cutting cylinder 7 cuts the paper web 1 into a cut sheet 101 having a predetermined length. The forward end of this sheet 101 held by the pin is also released, and then the cut sheet 101 is fed to a delivery fan 9 by the second-fold rollers 8.

An explanation of the configuration of the second-fold rollers 8 is given in detail with referring to FIG. 1. The second-fold rollers 8 are arranged in parallel each other. The rollers 8 are respectively provided with non-contact sections 81. In this embodiment, the non-contact section 81 is a recess partially formed in the cylindrical surface of the roller near each end. The cylindrical surface of this roller 8 excluding this partially formed recess 81 is so smooth as to adapt for a contact section 82.

Such configured second-fold rollers 8 receive the cut sheet 101 fed from the folding blade (not shown). In detail, the rollers 8 are revolving inwards and receive the cut sheet 101 therebetween. The lateral folding section 101*a* marked by the folding blade is forcibly restrained by nipping force of the second-fold rollers 8. As the rollers 8 revolve, the sheet 101 is laterally folded with achieving its vertically folded section 101*b* previously formed by the former 3. The second-fold rollers 8 are so controlled as to make the non-contact sections 81 face each other when the rear end of the folded sheet 101*c* is pushed off by the second-fold rollers 8. In order to perform this control the circumferential length of each second-fold roller 8 is so determined as to be slightly longer than that of the cut sheet 101. The revolving speed of the second-fold rollers 8 depends on its diameter and the rate of web feeding work from the folding cylinder 6 to the second-fold rollers 8. For example, in an ordinary case, the diameter of the second-fold roller 8 is determined to make its circumferential length be slightly longer than the length of the cut sheet 101 and its revolving speed is twice the times of web feeding operation per one rotation of the folding cylinder 6.

Figure 3:
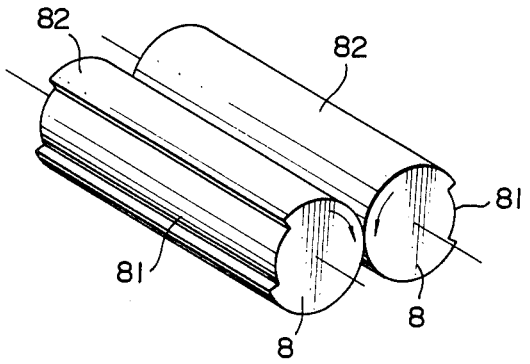
FIG. 3 is a schematic illustration showing one modification of the first embodiment shown in FIG. 1.
Figure 4:
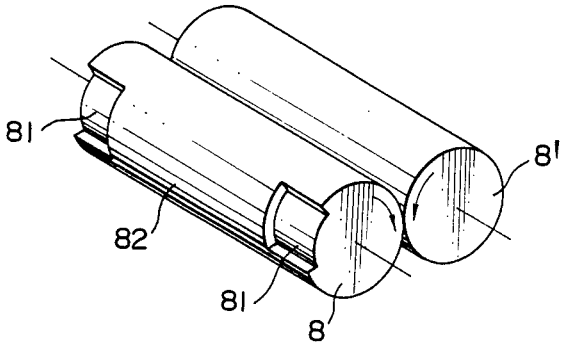
FIG. 4 is a schematic illustration showing another modification of the first embodiment shown in FIG. 1.

The second-fold rollers 8 can be modified in various configurations as shown in FIG. 3 and FIG. 4. In FIG. 3, each of the second-fold rollers 8 is formed with a longitudinal groove as a non-contact section 81. According to this configuration, when the paper sheet 101 is passed through the second-fold rollers 8, its rear end 101*c* is not applied with the nipping force of the second-fold rollers 8.

In FIG. 4, this modified roller pair is a combination of a conventional second-fold roller 8' without any non-contact section and the embodied second-fold roller 8 with the non-contact sections 81. In each embodiment, the non-contact section 81 is formed by a cylindrical surface recessed from the cylindrical surface forming the contact section 82. Radially and axially extending sidewalls connect these cylindrical surfaces.

Further, the contact section 82 of this second-fold roller may be formed with stripes, grooves or diamond-wise pattern conventionally employed as required.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. In a folding apparatus for forming folded sheets from an advancing paper web, comprising means for longitudinally folding the web to a given width, a pair of parallel second fold rollers forming a nip and having a length greater than said given width, and means for cutting the longitudinally folded web into sheets and inserting said sheets into the nip of said second fold rollers for forming a transverse fold in said sheets in such a manner that rear corners on said sheets pass between said second fold rollers, wherein each of the pair of said second fold rollers has a first cylindrical surface with at least one of the pair being provided with at least one non-contact section so formed in an end of the roller and extending coaxially with the longitudinal axis of the roller as to prevent contacting the rear corners of the sheets passing between the second-fold rollers, the non-contact section being a recess in the first cylindrical surface, said recess having a second cylindrical surface concentric with said first cylindrical surface and having sidewalls extending radially and coaxially with the longitudinal axis for interconnecting said first and second cylindrical surfaces.

2. The second-fold rollers for a folding device according to claim 1, wherein another non-contact section in formed in another end opposite said end of the roller, said one and another non-contact sections being separated by a portion of the first cylindrical surface.

3. The second-fold rollers for a folding device according to claim 2 wherein one of the pair of rollers is provided with the non-contact sections.

4. The second-fold rollers for a folding device according to claim 2 wherein each of the pair of rollers is provided with the non-contact sections.

5. The second-fold rollers for a folding device according to claim 1, wherein the pair of second-fold rollers comprises a first roller provided with a non-contact and a second roller having no non-contact section.

* * * * *